US005213157A

United States Patent [19]

Wills

[11] Patent Number: 5,213,157

[45] Date of Patent: May 25, 1993

[54] CLAMPING DEVICE FOR CAPPING OIL WELLS AND THE LIKE, AND APPARATUS FOR MOUNTING SAME

[76] Inventor: Robert Wills, 255 Mill Rd., 5Q, Staten Island, N.Y. 10306

[21] Appl. No.: 805,478

[22] Filed: Dec. 11, 1991

[51] Int. Cl.[5] ..... E21B 33/03; E21B 35/00; E21B 36/00; A65C 3/00

[52] U.S. Cl. ..... 166/79; 166/57; 166/92

[58] Field of Search ..... 166/75.1, 79, 57, 85, 166/92, 94, 96, 97, 302; 169/69

[56] References Cited

U.S. PATENT DOCUMENTS

| | | | |
|---|---|---|---|
| 1,345,214 | 6/1920 | Moore | 166/92 |
| 1,822,141 | 9/1931 | Gallaher | 169/69 |
| 2,257,269 | 9/1941 | Marsh et al. | 166/92 X |
| 4,337,831 | 7/1982 | Thaxton | 169/69 |
| 4,423,774 | 1/1984 | Mefford | 166/92 X |
| 5,121,793 | 6/1992 | Busch et al. | 166/79 |
| 5,121,797 | 6/1992 | DeCuir, Sr. | 166/79 |

*Primary Examiner*—Stephen J. Novosad

*Attorney, Agent, or Firm*—Goodman & Teitelbaum

[57] ABSTRACT

A clamping device is provided for capping a pipe carrying fluids therein, such as oil, water, chemicals, radio active material and the like, and also an apparatus for mounting the clamping device on the pipe. The clamping device includes clamping brackets for securement on the pipe, a capping member for insertion into the open end of the pipe, and securement members for securing the capping member to the clamping brackets. The apparatus includes closable jaws for securement to the clamping brackets, and arms including a carrier member for holding and positioning the capping member. The apparatus can be moved, controlled and manipulated at a safe distance from the pipe, and includes a rod mechanism for rotating and closing the jaws to engage the clamping brackets around the pipe, and a further rod mechanism for raising, lowering and rotating the arms to properly position the capping member within the open end of the pipe. Preferably, the apparatus is provided with a device for spraying the clamping device and the pipe with water, chemicals or any other suitable liquid material for cooling same.

20 Claims, 7 Drawing Sheets

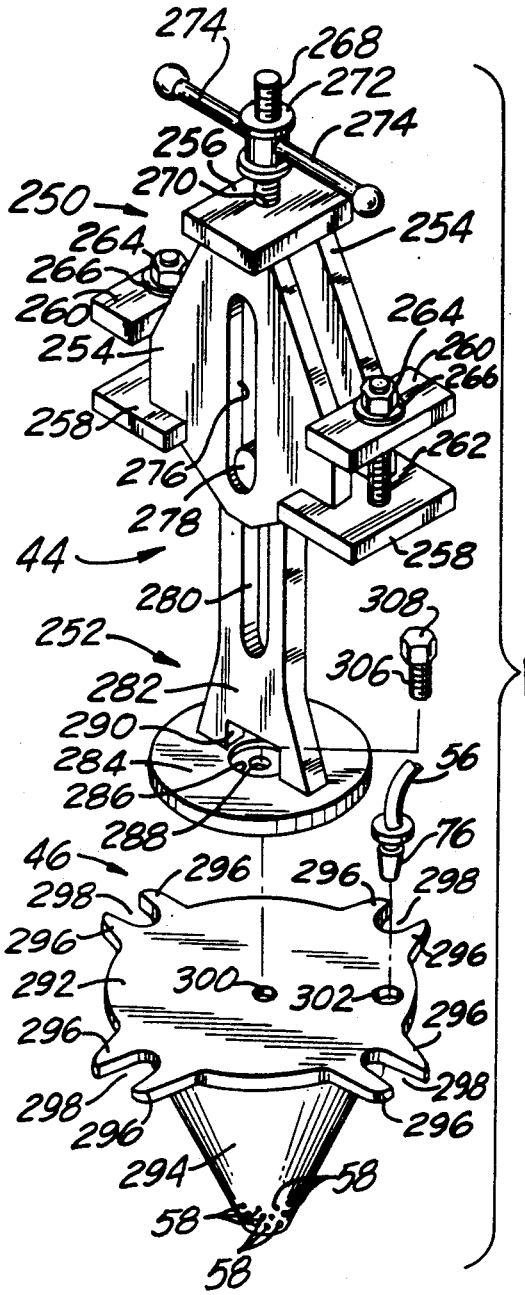
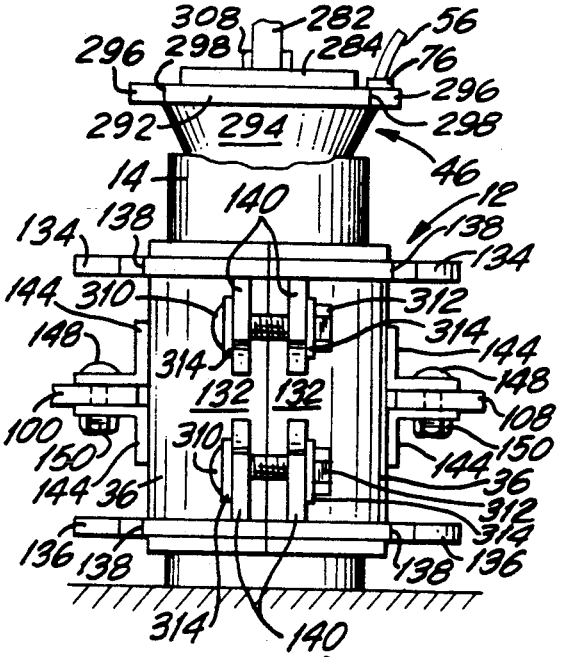
FIG.13 FIG.14
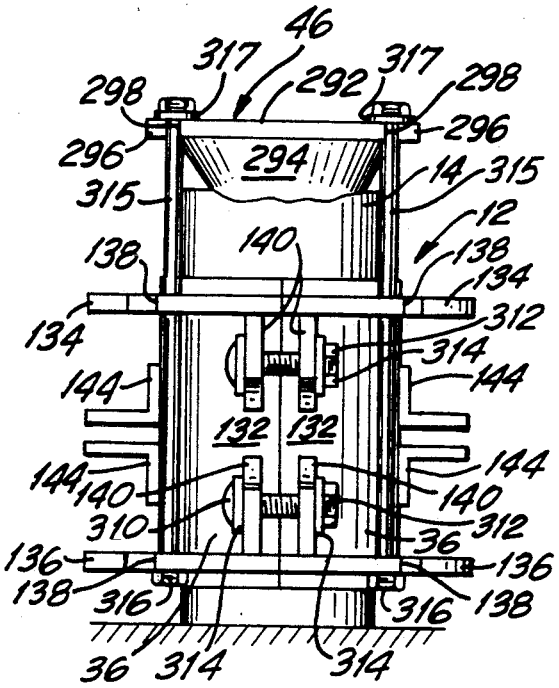
FIG.15

CLAMPING DEVICE FOR CAPPING OIL WELLS AND THE LIKE, AND APPARATUS FOR MOUNTING SAME

BACKGROUND OF THE INVENTION

The invention relates to a clamping device for capping any type of pipe carrying fluids therein, such as pipes carrying oil, water, chemicals, radio active material, and the like, and more particularly, for capping pipes in which the fluid therein is on fire, such as oil well fires, where the invention also relates to the apparatus for mounting the clamping device on the fluid carrying pipe for capping same, such as to put out the oil well fire.

Recently, there is a great need to put out a very large number of oil well fires in one area, where the prior art methods such as using explosives, water, chemicals, sand and the like to put out such fires have not been very efficient and require a great deal of time in order to put out each of the fires. Due to the fact that the burning oil wells have been found to pollute the environment, and that the burning oil is costing the owners of the oil wells a considerable amount of money, it is desirable to put out the oil well fires in an efficient manner as soon as possible. Furthermore, there is a need to put out the oil well fires in such a manner which would not endanger the persons who are putting out the fires, such as could be expected when explosives are used.

U.S. Pat. No. 1,822,141 discloses means for closing oil wells including a plug adapted to be located at an open end of an oil well, in combination with means activated by the pressure escaping from the well to rotate the plug, and further means in association with the plug for moving the plug longitudinally to a proper position in the well in order to close the well. Additional means are provided in this patent for connecting the plug to the well to permit rotation of the plug into the well. It is noted, that this patent is only directed to means for closing oil wells, and is not intended to be used to put out oil well fires, particularly in view of the structure thereof which is not designed to be fire resistant.

Accordingly, there is present a need for a clamping device and an apparatus for mounting same in order to put out oil well fires and the like in an efficient manner, in a short amount of time, and at a safe distance from the oil well fires.

SUMMARY OF THE INVENTION

It is accordingly an object of the present invention to provide a clamping device for capping any type of pipe carrying fluids therein, such as pipes carrying oil, water, chemicals, radio active material, and the like, and even for capping oil wells and the like which are on fire, and to also provide an apparatus for mounting the clamping device on the fluid carrying pipe for capping same, which avoids the problems of the prior art devices.

Another object of the present invention is to provide a clamping device for capping fluid carrying pipes which includes clamping brackets for securement on the pipe, and a capping member for insertion into the open end of the pipe.

A further object of the present invention is to provide a clamping device, as mentioned above, which includes means for securing the capping member to the clamping brackets.

Still another object of the present invention is to provide a clamping device, as mentioned above, which can be easily produced, is inexpensive to manufacture, and which can be quickly secured to the pipe.

Another object of the present invention is to provide an apparatus for mounting the above-mentioned clamping device, which is capable of being moved towards the pipe while carrying the clamping device.

Another object of the present invention is to provide an apparatus, as mentioned above, which includes closeable jaw means for securement to the clamping brackets, and arm means including a carrier member for holding and positioning the capping member of the clamping device.

A further object of the present invention is to provide an apparatus, as mentioned above, which includes means for rotating and closing the jaw means, and further means for raising, lowering and rotating the arm means in order to properly position the clamping device relative to the pipe.

An additional object of the present invention is to provide an apparatus, as mentioned above, which includes means for spraying the clamping device and the pipe with water, chemicals or any other suitable liquid material for cooling same.

A further object of the present invention is to provide an apparatus, as mentioned above, which can be moved, controlled and manipulated at a safe distance from the pipe, particularly when the apparatus is used for putting out oil well fires and the like.

Briefly, in accordance with the present invention, there is provided a clamping device for capping a pipe carrying fluids therein, such as oil, water, chemicals, radio active material, and the like, and also an apparatus for mounting the clamping device on the pipe. The clamping device includes clamping brackets for securement on the pipe, a capping member for insertion into the open end of the pipe, and means for securing the capping member to the clamping brackets.

The apparatus includes closable jaw means for securement to the clamping brackets, and arm means including a carrier member for holding and positioning the capping member. The apparatus can be moved, controlled and manipulated at a safe distance from the pipe, and includes means for rotating and closing the jaw means to engage the clamping brackets around the pipe, and further means for raising, lowering and rotating the arm means to properly position the capping member within the open end of the pipe. Preferably, the apparatus is provided with means for spraying the clamping device and the pipe with water, chemicals or any other suitable liquid material for cooling same.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which:

FIG. 13 is an exploded perspective view showing a carrier member of the apparatus for holding and positioning the capping member of the clamping device;

FIG. 14 is a fragmented front elevational view showing the clamping device positioned on the oil well pipe;

FIG. 15 is a front elevational view similar to FIG. 14, showing the clamping device clamped on the oil well pipe;

In the various figures of the drawings, like reference characters designate like parts.

DESCRIPTION OF THE PREFERRED EMBODIMENT

Figure 1:
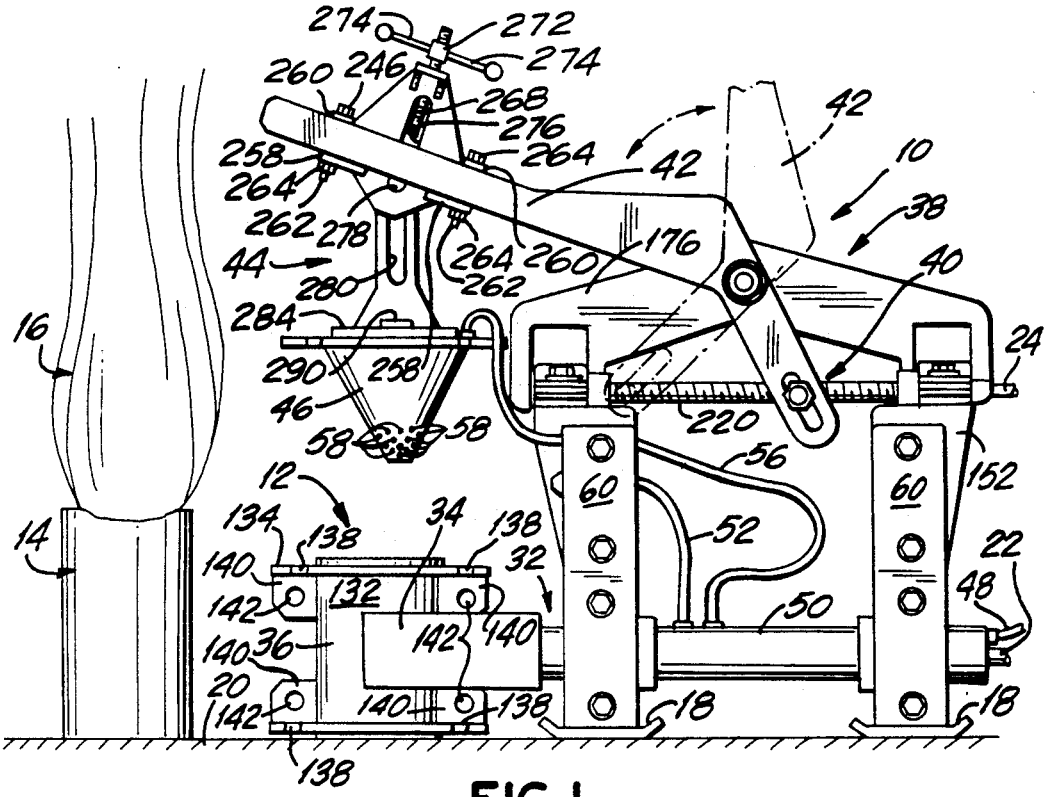
FIG. 1 is a side elevational view showing a clamping device for capping oil wells and the like, and an apparatus for mounting same, showing the apparatus in a raised position prior to positioning the clamping device on the oil well pipe, in accordance with the present invention.

Referring now to the drawings, FIG. 1 shows an apparatus 10 which is used for putting out oil well fires and the like, particularly for mounting a clamping device 12 on an oil well pipe 14 for capping same. The oil well pipe 14 is broken or damaged and, in most cases, has flames 16 streaming out therefrom. It is understood, that the apparatus 10 and the clamping device 12 could also be used for capping any type of pipe carrying fluids therein, such as pipes carrying water, chemicals, radio active material, and the like, and even for oil well pipes that are not broken or damaged.

Figure 2:
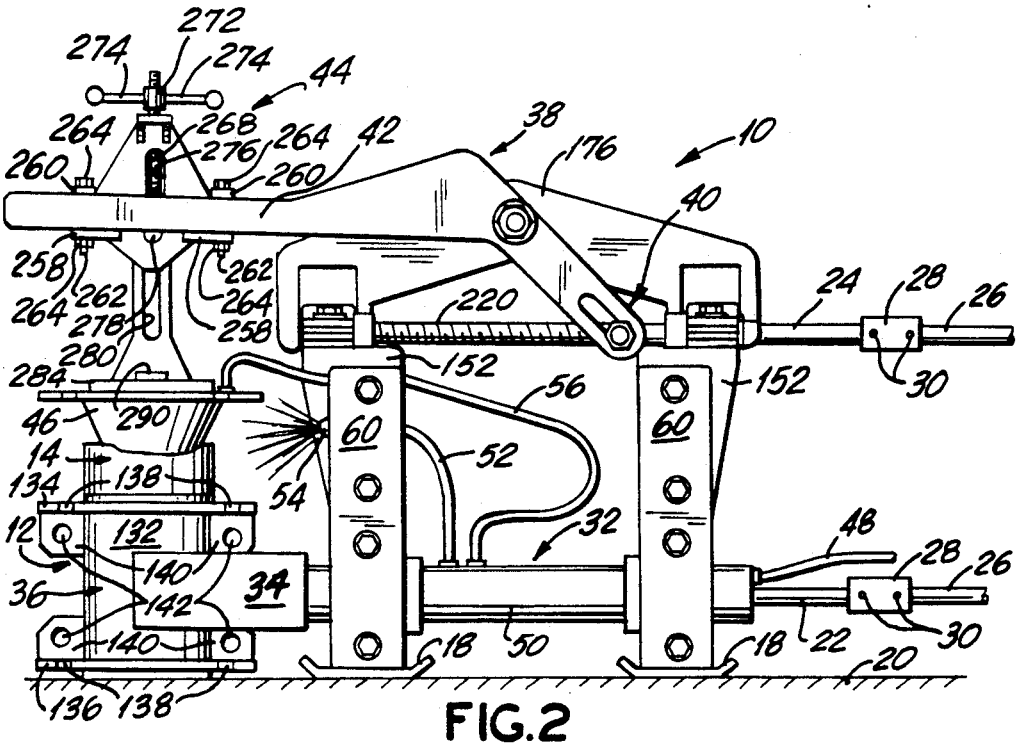
FIG. 2 is a side elevational view similar to FIG. 1, showing the apparatus in a lowered position with the clamping device positioned on the oil well pipe for capping same.

The apparatus 10 is mounted on skids 18 so that it could be pushed on the ground 20 towards the pipe 14 by pushing on the rods 22, 24. It is noted, as shown in FIG. 2, that extension rods 26 can be attached to the rods 22, 24 by coupling members 28 which are secured to the rods by screws 30 in a conventional manner so that by adding as many as required additional extension rods 26 and coupling members 28, the lengths thereof can be increased as predetermined so that the apparatus 10 can be pushed from a safe substantial distance spaced away from the pipe 14.

The apparatus 10 includes a lower portion 32 provided with closable jaws 34 which are secured to the clamping brackets 36 of the clamping device 12. An upper portion 38 of the apparatus 10 includes a mechanism 40 for raising, lowering and rotating the arms 42 of the upper portion 38 of the apparatus 10. A carrier member 44 is secured on the arms 42 for holding and positioning a capping member 46 of the clamping device 12. The lower portion 32 and the upper portion 38 of the apparatus 10 and the parts thereof will be described below in more detail.

Preferably, a water line 48 is connected in flow communication with a hollow tubular member 50 of the lower portion 32. A first water hose 52 extends out of the tubular member 50 and is provided with a nozzle 54 on the free end thereof directed towards the clamping brackets 36 of the clamping device 12 for spraying water or any other suitable material thereon. A second water hose 56 also extends out of the tubular member 50 with the opposite end being inserted into the upper portion of the capping member 46. The capping member 46 is hollow, and is provided with numerous openings 58 at the lower end portion thereof so that water or any other suitable liquid material can flow from the hose 56 into the capping member 46 and out therefrom through the openings 58.

When the apparatus 10 is being moved towards the pipe 14, the jaws 34 of the lower portion 32 are opened so that the clamping brackets 36 of the clamping device 12 are spaced apart to receive the pipe 14 therebetween. Additionally, the arms 42 of the upper portion 38 are in the raised position, as shown in FIG. 1, so that the carrier member 44 and the capping member 46 of the clamping device 12 secured thereon are sufficiently raised in order to provide sufficient clearance for the capping member 46 to be inserted into the open end of the pipe 14. Accordingly, the height of the capping member 46 can be adjusted by the mechanism 40 to raise or lower the arms 42, where the maximum amount the arms 42 can be raised is shown in broken lines in FIG. 1.

When the pipe 14 is positioned between the clamping brackets 36, with the capping member 46 being disposed above the opening of the pipe 14, the movement of the apparatus 10 is stopped. The jaws 34 are now moved to the closed position, as will be explained below, so that the clamping brackets 36 are engaged around the pipe 14. Additionally, the mechanism 40 now lowers the arms 42, as will be explained below, so that the capping member 46 is inserted into the opening in the pipe 14 for capping same, as shown in FIG. 2. During these operations, the water line 48 is activated so that the water or any other suitable liquid material flows through the water line 48 into the hollow tubular member 50 of the lower portion 32, into the water hoses 52, 56, and into and onto the pipe 14 and areas surrounding the pipe 14 for cooling same. The parts of the apparatus 10 will now be explained below.

Figure 3:
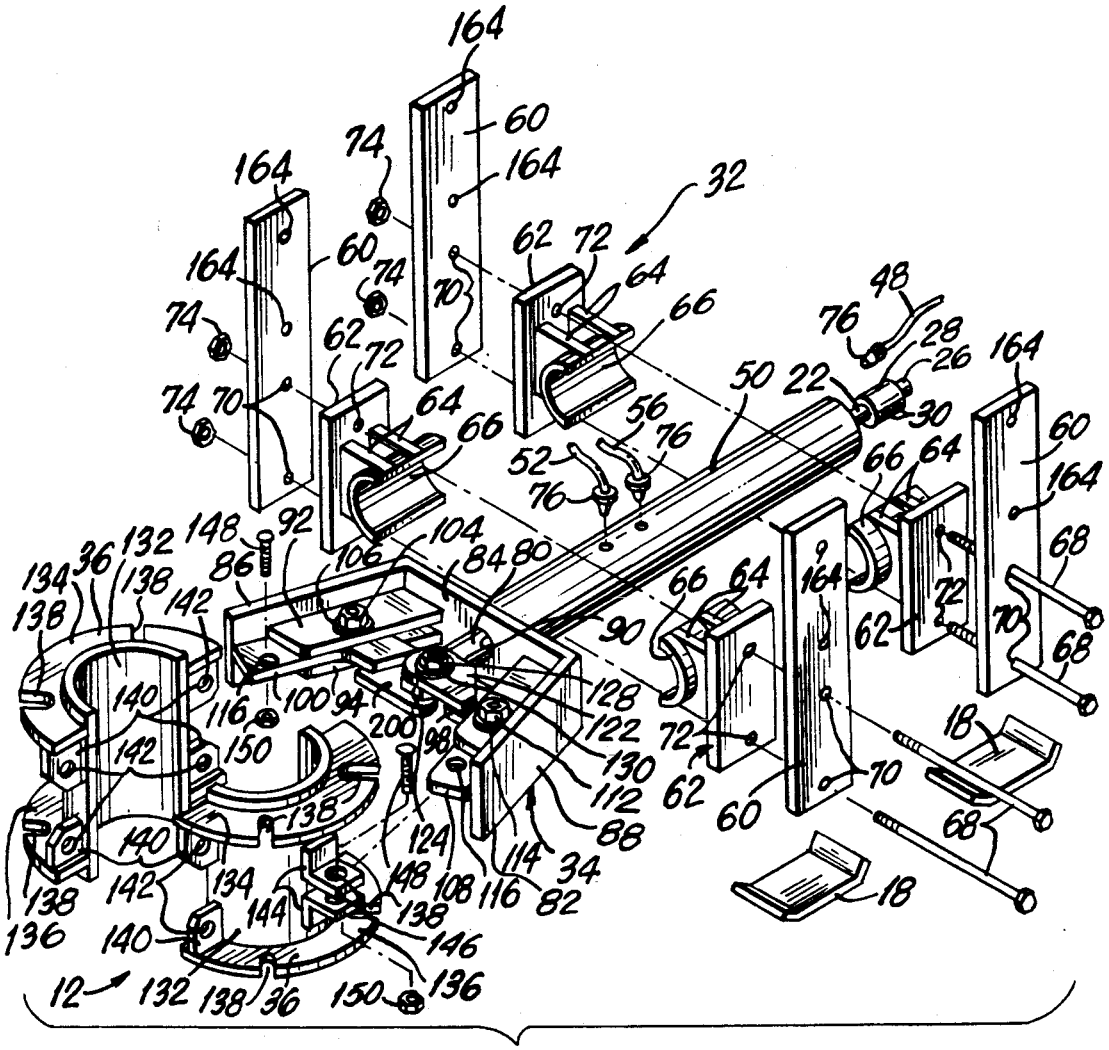
FIG. 3 is an exploded perspective view of a lower portion of the apparatus and the related clamping brackets of the clamping device.
Figure 19:
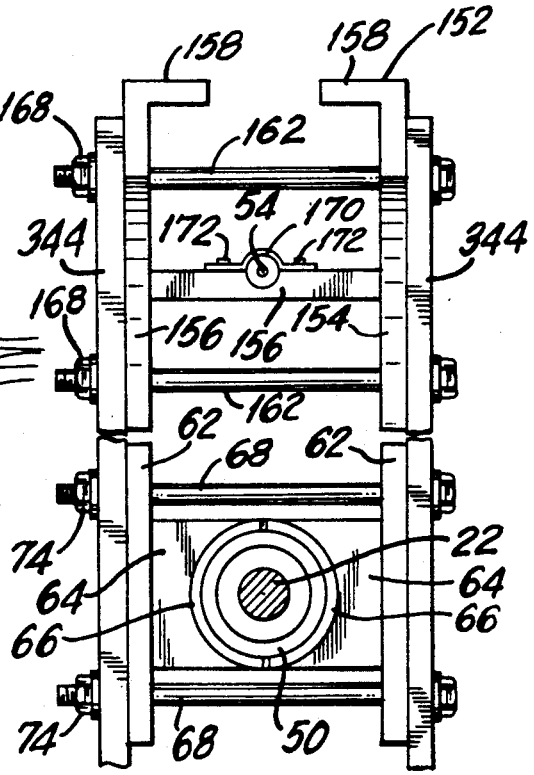
FIG. 19 is a fragmented front elevational view showing a modified frame member.

FIG. 3 shows the lower portion 32 of the apparatus 10, which includes four upwardly extending outer frame members 60, which are also part of the upper portion 38, and also four upwardly extending shorter inner frame members 62 associated therewith. Each of the inner frame members 62 includes inwardly directed brackets 64 thereon for supporting a semi-circular support member 66. Accordingly, pairs of the support members 66 are disposed on opposite sides of the tubular member 50, with one pair of support members 66 being disposed on a front portion of the tubular member 50, and the other pair of support members 66 being disposed on a rear portion of the tubular member 50. The outer frame members 60 are now disposed against associated inner frame members 62 and secured thereto by bolts 68 passing through appropriate holes 70 in the outer frame members 60 and appropriate aligned holes 72 in the inner frame members 62, the bolts 68 being secured on the ends thereof by associated nuts 74, as indicated in FIG. 19. It is understood, that the bolts 68 and buts 74 can be replaced by any suitable securing means, such as by welding the parts together. One of the skids 18 is secured to the lower ends of the front outer frame members 60, and the other skid 18 is secured to the lower ends of the rear outer frame members 60 by suitable means, such as by welding.

The tubular member 50 is provided with sealing means for a water tight arrangement so that the water or other suitable liquid material received therein from the water line 48 will not leak out of the tubular member 50. As shown in FIG. 3, a water tight sealing plug 76 is provided on the ends of the water line 48 and the water hoses 52, 56 for insertion into the holes 78 provided on the upp-r side surface and rear end surface of the tubular member 50 to secure the water line 48 and the water hoses 52, 56 in a water tight arrangement to the tubular member 50. A plunger 80 is secured to the forward end of the rod 22, where the rod 22 passes longitudinally, completely through the tubular member 50. Accordingly, the sealing means are provided around the openings, not shown, in the opposite ends of the tubular member 50 through which the rod 22 and the plunger 80 pass to maintain the water tight arrangement of the tubular member 50 while the rod 22 and plunger 80 are being rotated and moved back and forth in their respective end openings, where the rotational and back and forth movement of the rod 22 and plunger 80 will be explained below.

As shown in FIGS. 3–6, the jaws 34 include a substantially U-shaped support member 82 having a bse wall 84 and leg walls 86, 88 extending outwardly from the base wall 84 in a direction away from each other. A hole 90 is centrally provided in the base wall 84 to movably receive the plunger 80 therethrough, see FIG. 3. A pair of spaced apart upper and lower brackets 92, 94 are provided on the inner surfaces of the leg member 86 and the inner end portion of the base wall portion 84, and an additional pair of spaced apart upper and lower brackets 96, 98 are likewise provided on the inner surfaces of the leg wall 88 and the opposite end portion of the base wall 84.

A first L-shaped member 100 is disposed between the brackets 92, 94, being pivotally secured therebetween by a bolt 102 passing through aligned holes provided therein and secured by a nut 104, where washers 106 may be provided if desired. Likewise, a second L-shaped member 108 is disposed between the brackets 96, 98, being pivotally secured therebetween by a bolt 110 passing through aligned holes provided therein and secured by a nut 112, where washers 114 may be provided if desired. Holes 116, 118 are provided in the free end portions of the L-shaped members 100, 108, the function of which will be described below.

An extension member 120 is secured to the bottom end portion of the shorter leg of the L-shaped member 100, and another extension member 122 is secured to the top end portion of the shorter leg portion of the L-shaped member 108 so that the free end portions of the extension portions 120, 122 are disposed one above the other in a parallel spaced apart arrangement. The plunger 80 has a flat end section 124 disposed between the extension portions 120, 122. A bolt 126 extends through aligned openings in the plunger end section 124 and the extension portions 120, 122 to pivotally secure these parts together, with the bolt 126 being held in place by a nut 128, where washers 130 can be used if desired. The operation of the jaws 34 will be discussed below.

As best shown in FIG. 3, there are two identical clamping brackets 36 of the clamping device 12, each including a semi-circular body member 132 having upper and lower semi-circular flanges 134, 136 secured to the outer wall thereof. Two slots 138 is provided in each flange 134, 136 at a predetermined distance from each other, the upper slots 138 being in alignment with the bottom slots 138, the function of which will be described below. Additionally, upper and lower vertically extending brackets 140 having a centrally located hole 142 are disposed on upper and lower opposite end portions of each clamping bracket 36, being secured to the outer surface of the body member 132 and also to the associated flange 134, 136, the function of which will also be discussed below.

A pair of L-shaped brackets 144 are secured to a centrally located portion on the outer surface of each body member 132 in a spaced apart arrangement. Aligned holes 146 are provided through the horizontally disposed legs of the brackets 144. Accordingly, the free end portions of the L-shaped members 100, 108 are inserted between the pair of brackets 144 so that the holes 146 of the brackets 144 and the holes 116, 118 of the L-shaped members 100, 108 are in alignment with each other, respectively. Bolts 148 passing through the holes 116, 118, 146 and associated nuts 150 pivotally secure the brackets 144 of the clamping brackets 36 together with the L-shaped members 100, 108 so that the clamping brackets 36 are pivotally mounted on the jaws 34.

Figure 4:
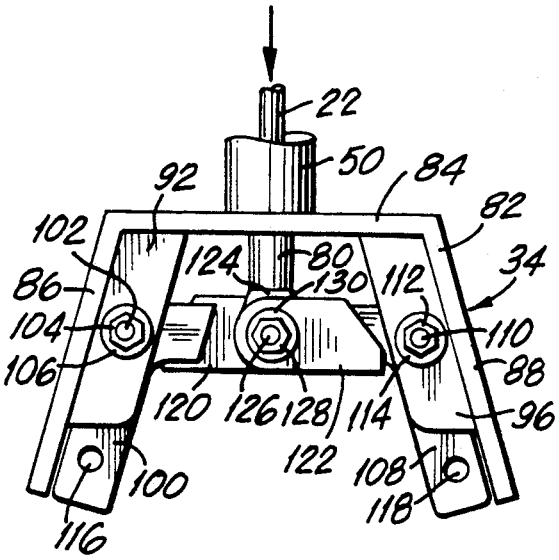
FIG. 4 is a top plan view of the closable jaws of the apparatus in an open position.
Figure 5:
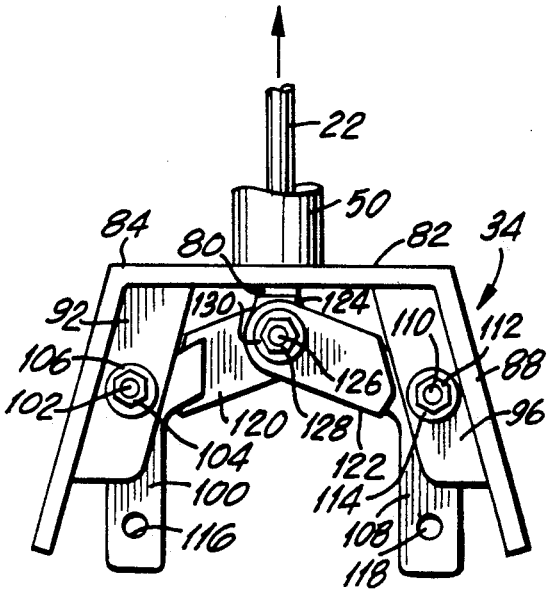
FIG. 5 is a top plan view of the closable jaws of the apparatus in a closed positon.
Figure 6:
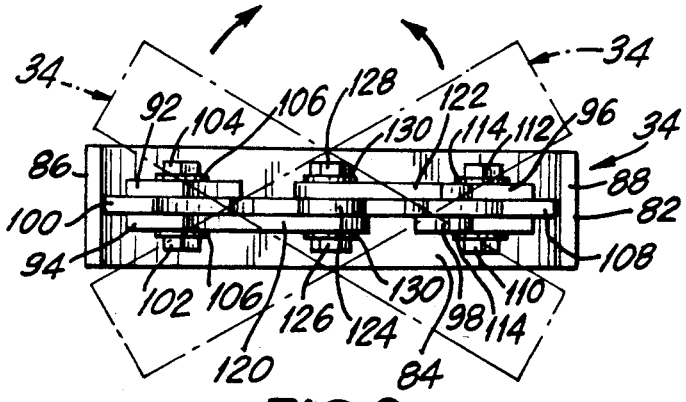
FIG. 6 is a front elevational view of the closable jaws in the open position of FIG. 4.

In operation, as shown in FIGS. 4–6, when the rod 22 is pushed forward to move the apparatus 10 towards the pipe 14, the jaws 34 are in the open position, as shown in FIG. 4, so that the clamping brackets 36 mounted thereon are in a spaced apart arrangement. Once the pipe 14 is positioned between the clamping brackets 36, similar to that shown in FIG. 2, the rod 22 is pulled back rearwardly to close the jaws 34, as shown in FIG. 5, so that the clamping brackets 36 are pivoted towards each other and are positioned around the pipe 14, as shown in FIG. 2.

Accordingly, when the rod 22 is pulled back rearwardly, the plunger 80 connected thereto also moves rearwardly so that the plunger end section 124 pivots the extension members 120, 122 towards the rear of the support member 82, which in turn causes the L-shaped members 100, 108 to pivit towards each other. Thus, the clamping brackets 36 which are connected to the L-shaped members 100, 108, are also forced to pivot towards each other to an engagement position around the pipe 14. In this engagement position, the holes 142 in the brackets 140 on one clamping bracket 36 are in alignment with associated holes 142 in the brackets 140 on the other clamping bracket 36, as will be explained below.

As shown in FIG. 6, rotating the rod 22 will also rotate the jaws 34 as indicated in broken lines. Accordingly, sometimes when the oil well pipe and the like is broken or damaged, the oil well pipe and the like will sometimes be hit or moved to an inclined position. Thus, when the oil well pipe and the like is at such an inclined position, the jaws 34 can be rotated to match the inclined position of the pipe to enable the clamping brackets 36 to be positioned on the inclined pipe by the clamping jaws 34.

Figure 7:
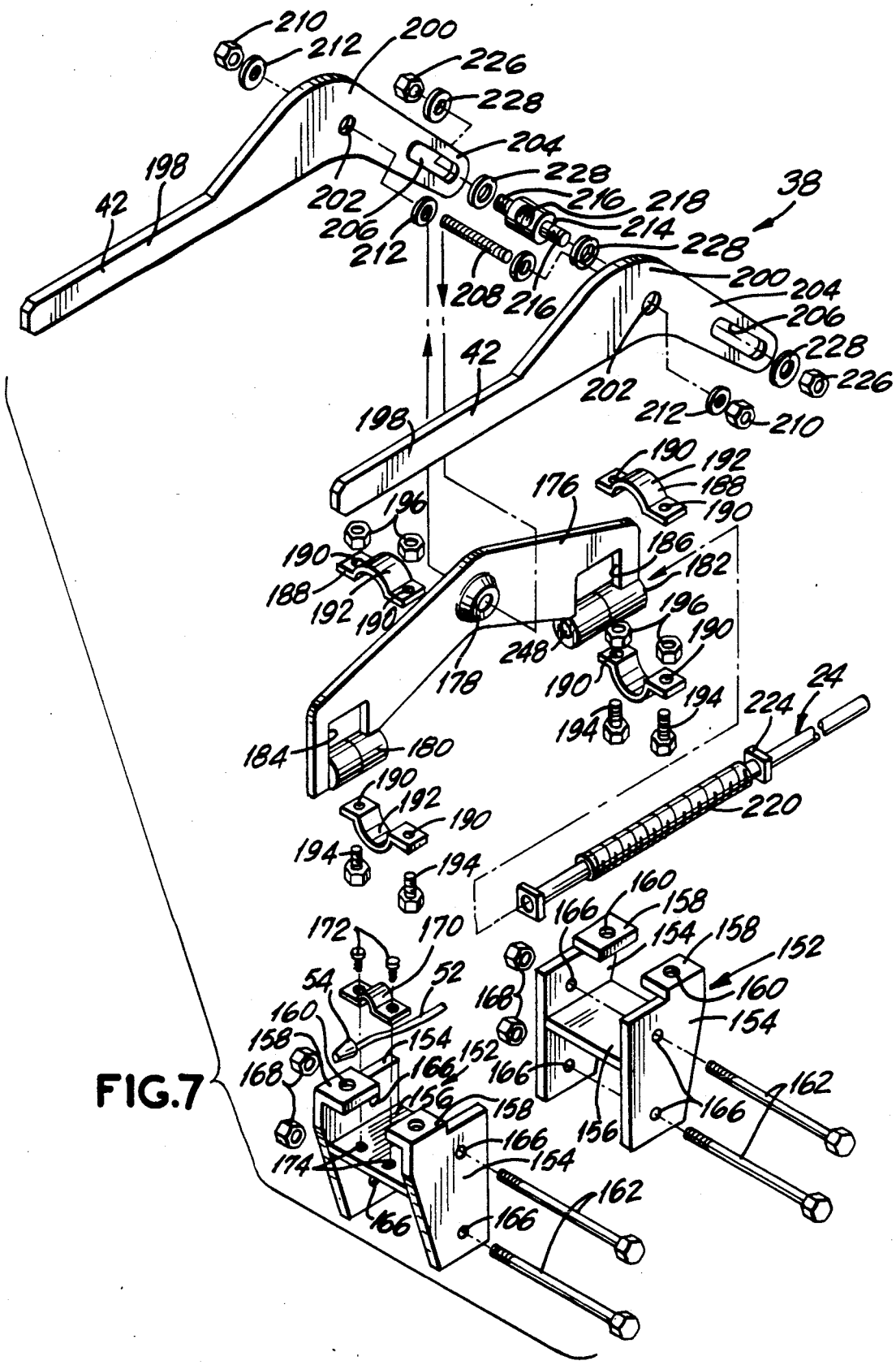
FIG. 7 is an exploded perspective view of the upper portion of the apparatus.

FIG. 7 shows the upper portion 38 of the apparatus 10, which includes two identical H-shaped inner frame members 152, with one frame member 152 being turned 180° relative to the other frame member 152. The inner frame members 152 extend upwardly a shorter length than the outer frame members 60 for association with upper portions thereof. Each inner frame member 152 includes vertically extending panels 154 and a centrally located horizontal support panel 156 connecting each pair of vertical panels 154 together. A horizontal support portion 158 having a centrally located hole 160 therethrough is disposed on the top edge of each vertical panel 154 adjacent to an edge thereof.

Accordingly, the outer surfaces of the vertical panels 154 of the inner frame members 152 are disposed against the upper inner surfaces of the associated outer frame members 60, and are secured thereto by bolts 162 passing through appropriate holes 164 in the outer frame members 60 and appropriate aligned holes 166 in the inner frame members 152, the bolts 162 being secured by associated nuts 168. Furthermore, the end portion of the hose 52 having the nozzle 54 thereon is secured to the horizontal panel 156 of the front inner frame member 152 by a suitable bracket 170 and associated screws 172 engageable in threaded holes 174 provided in the upper surface of the support panel 156. A front view of the securement arrangement between the inner frame members 152 of the upper portion 38 and the outer frame members 60 is substantially shown in FIG. 19.

The upper portion 38 also includes a yoke member 176 having a V-shaped configuration with a bushing 178 disposed through the center thereof in a secured position. Cylindrical support members 180, 182 are secured to the opposite lower ends of the yoke member 176 for receiving the rod 24, as will be explained below. A cut out 184, 186 is provided above each of the support members 180, 182, respectively.

Two upper and two lower identical brackets 188 are provided with holes 190 extending through opposite end portions of each bracket 188, and each includes a semi circular intermediate collar portion 192. The lower brackets 188 are positioned on the support portions 158 of the inner frame members 152 with the collar portions 192 thereof extending downwardly to receive the support members 180, 182 therein. The upper brackets 188 are disposed in the cut outs 184, 186 of the yoke member 176 with the collar portions 192 thereof extending upwardly for placement on the support members 180, 182, and with the end portions of the upper brackets 188 resting on the end portions of the lower brackets 188. Accordingly, the holes 190 of the associated upper and lower brackets 188 are positioned in alignment with each other, and also in alignment with the holes 160 in the associated support portions 158 of the front and rear inner frame members 152 so that associated bolts 194 can pass through the aligned holes 160, 190 for engagement with nuts 196 disposed on the upper brackets 188. Thus, the brackets 188 secure the yoke member 176 to the inner frame members 152 in such a manner to permit the yoke member 176 to be rotated relative to the inner frame members 152, as will be discussed below.

The two arms 42 of the upper portion 38 are identical, each including a straight flat elongated front portion 198, an enlarged flat central portion 200 having a hole 202 therethrough, and a straight flat shorter rear portion 204 extending downwardly and away from the front portion 198 and having an elongated slot 206 in the free end portion thereof. The arms 42 are positioned on opposite sides of the yoke member 176 so that the holes 202 in the central portion 200 are in alignment with the hole in the bushing 178 of the yoke member 176 to receive therethrough a threaded stud 208. The ends of the threaded stud 208 are engaged by nuts 210 disposed on opposite sides of the arms 42, and appropriate washers 212, in order to pivotally secure the arms 42 on opposite sides of the yoke member 176.

Additionally, a cylindrical drive member 214 is provided with threaded studs 216 extending outwardly from opposite ends of the drive member 214. A threaded hole 218 is provided transversely through the drive member 214 for threadably receiving a threaded portion 220 of the rod 24, where the drive member 214 and the threaded portion 220 of the rod 24 form parts of the above-mentioned mechanism 40, as will be explained below.

The rod 24 also includes a square shaped member 222 secured on the free forward end thereof and another square shaped member 224 secured rearwardly of the threaded portion 220. Accordingly, the drive member 214 is threadedly disposed on the threaded portion 220 of the rod 24 and the square shaped members 222, 224 are disposed within the support members 180, 182 of the yoke member 176, as will be described further below.

The drive member 214 is also disposed between the rear portions 204 of the arms 42 so that the studs 216 extend through the slots 206 of the rear portions 204. Nuts 226 are disposed on the ends of the studs 216 on opposite sides of the rear portions 204 to secure the arms 42 together, where appropriate washers 228 may be used as desired. Thus, as the drive member 218 is threadingly moved along the threaded portion 220 of the rod 24, the arms 42 will be appropriately pivoted about the bushing 178 of the yoke member 176, as will now be described below.

As shown in FIGS. 8-11, the front support member 180 has a front section 230 having a square hole 232 therein to matingly receive the square shaped member 222 of the rod 24, and also a rear section 234 having an enlarged circular hole 236 therein to also receive the square shaped member 222 therein in a second pulled back position of the rod 24. Likewise, the rear support member 182 has a front section 238 having a square hole 240 therein to matingly receive the square shaped member 224 of the rod 24, and also a rear section 242 having an enlarged circular hole 244 therein to also receive the swuare shaped member 224 therein in the second pulled back position of the rod 24.

Figures 8, 11:
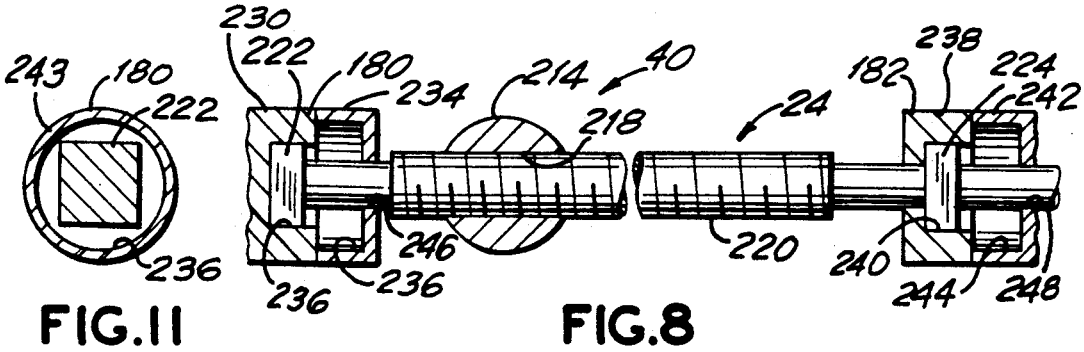
FIG. 8 is a fragmented sectional view of the mechanism for raising, lowering and rotating the arms of the upper portion of the apparatus, showing the mechanism in the position for rotating the arms.
FIG. 11 is a sectional view taken along line 11—11 of FIG. 9.
Figure 12:
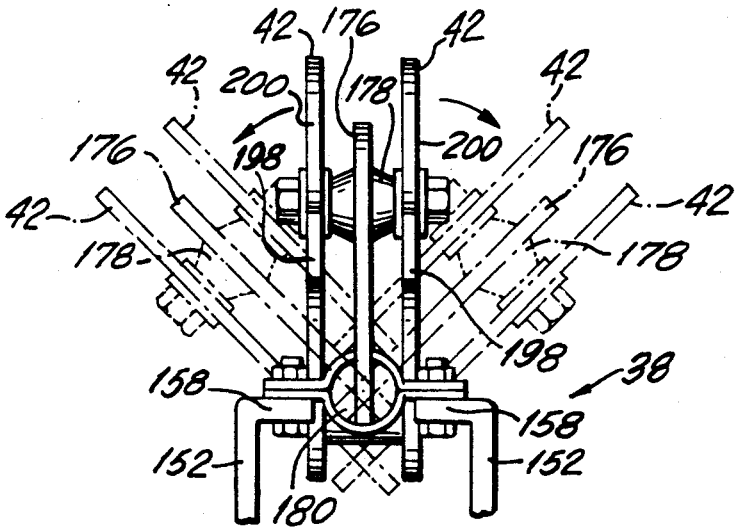
FIG. 12 is a fragmented front elevational view of the arms of the upper portion of the apparatus.

Accordingly, when the apparatus 10 is being pushed towards the pipe 14, as shown in FIG. 1, the drive member 214 is threadingly mounted on the front portion of the threaded portion 220 of the rod 24, as shown in FIG. 8, so that the arms 42 are in their upper most raised position as indicated in broken lines in FIG. 1. At the same time, the rod 24 is in a first pushed forward position so that the square shaped members 222, 224 are engated in their respective square holes 232, 240, thus the rod 24 can be used to push the apparatus 10 towards the pipe 14. This engagement of the square shaped members 222, 224 of the rod 24 causes the yoke member 176 and the arms 42 to be rotated, in either direction, when the rod 24 is rotated, as shown in FIG. 12. As mentioned above, the oil well pipe and the like is sometimes disposed in an inclined position when broken or damaged, so that the above-mentioned structure permits the rod 24 to rotate the arms 42 to match the inclined position of the pipe to enable the capping member 46, discussed further below, to be positioned into the opening in the inclined pipe.

It is noted, that though the members 222, 224 and their associated holes 232, 240 have been shown square shaped, any non-circular shape can also be used in order for the rod 24 to rotate the yoke member 176.

Figures 9, 10:
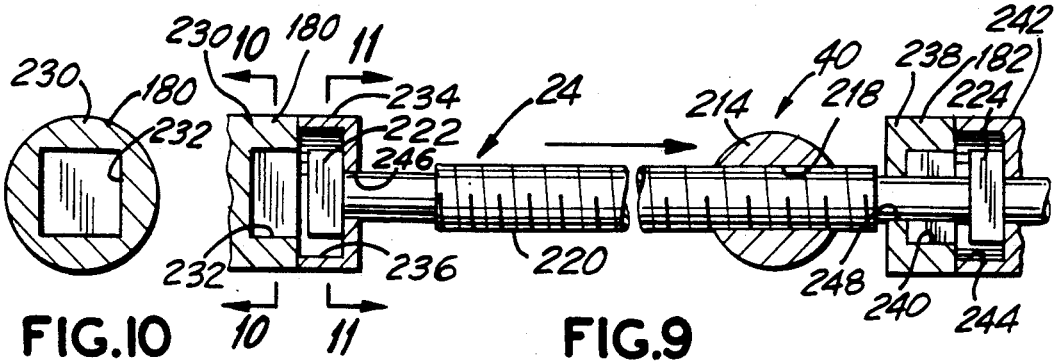
FIG. 9 is a fragmented sectional view similar to FIG. 8, showing the mechanism in the position for raising and lowering the arms.
FIG. 10 is a sectional view taken along line 10—10 of FIG. 9.

FIG. 9 shows the rod 24 in the second pulled back position so that the square shaped members 222, 224 are now disposed in their respective enlarged circular holes 236, 244. In this second pulled back position, the rod 24 is now free to rotate relative to the support members 180, 182 of the yoke member 176 in that the enlarged circular holes 236, 244 are larger than their respective square shaped members 222, 224. Thus, rotation of the rod 24 causes the drive member 214 to threadedly move rearwardly along the threaded portion 220. Accordingly, when the apparatus 10 is adjacent to the pipe 14, and the clamping brackets 36 are in the engagement position around the pipe 14, as indicated in FIG. 2, the rod 24 is rotated to move the drive member 214 rearwardly along the threaded portion 220 so that the drive member 214 also moves the rear portions 204 of the arms 42 rearwardly to pivot the arms 42 and thus lower the front portions 198 of the arms 42. FIG. 9 shows the drive member 214 in its rear most position on the threaded portion 330, in which position the arms 42 are in their lowered position as shown in FIG. 2.

It is noted, that the square hole 232 is in communication with the enlarged circular hole 236 of the front support member 180, where the rod 24 extends into the circular hole 236 through a hole 246. Likewise, the square hole 240 is in communication with the enlarged circular hole 244 of the rear support member 182, where a hole 248 horizontally extends entirely through the rear support member 182 and is in communication with both the square hole 240 and the enlarged circular hole 244 for receiving the rod 24 therethrough.

FIG. 13 is a detailed showing of the carrier member 44 and the capping member 46. The carrier member 44 includes an upper mounting portion 250 and a lower carrier portion 252 pivotally secured to the upper mounting portion 250. The mounting portion 250 includes two identical spaced apart side members 254 secured together by a plate 256 at the top thereof and two lower bracket portions 258 at opposite lower edges thereof to define a secured unit construction.

Two upper bracket portions 260 are connected respectively to the two lower bracket portions 258 by bolts 262 passing through appropriate aligned holes in the respective lower and upper bracket portions 258, 260 and appropriate nuts 264 at opposite ends of the bolts 262, where appropriate washers 266 can be used. Accordingly, the side members 254 are positioned between the front portions 198 of the two arms 42 with the lower bracket portions 258 being disposed against the lower edges of both front portions 198, and with the upper bracket portions 260 being disposed against the upper edges of both front portions 198. The nuts 264 are then tightened to secure the upper mounting portion 250 to the arms 42, as best shown in FIGS. 1 and 2.

A threaded stud 268 is threaded through a threaded opening 270 in the plate 256 so that the threaded stud 268 extends downwardly between the spaced apart side members 254. A pulley 272 is secured in a fixed position on the upper portion of the threaded stud 268. A pair of outwardly extending handle bars 274 are secured to opposite sides of the pulley 272, the function of which will be described below.

A pair of aligned vertically extending elongated slots 276 is provided in the side members 254. A pin 278 is positioned in each of the slots 276 for vertical movement therein. The pin 278 is secured in a fixed position to the upper end portion of the lower carrier portion 252 so that the pin 278 guides the carrier portion 252 up and down between the side members 254 while permitting the carrier portion 252 to pivot relative to the mounting portion 250. The carrier portion 252 has an elongated vertical slot 280 in alignment with the slots 276 of the mounting member 250 so that when the carrier portion 252 is raised between the side members 254, a bolt (not shown) can be inserted through the slots 276, 280 in order to secure the carrier portion 252 in the raised position.

The lower portion 282 of the carrier portion 252 is tapered outwardly to increase the size thereof, and is secured to a circular horizontal plate 284. The plate 284 has a recess 286 centrally located in the upper surface thereof, with a centrally located hole 288 in the bottom of the recess 286 passing through the plate 284. A cut out 290 is provided in the lower portion 282 of the carrier portion 252 directly above the recess 286, the purpose of which will be explained below.

The capping member 46 includes an upper plate portion 292 and a lower conically shaped hollow portion 294 connected to the lower surface of the plate portion 292. The plate portion 292 includes spaced apart, outwardly extending pairs of lug portions 296, preferably four pairs of equally spaced apart lug portions 296, to provide an open slot 298 between the lug portions 296 of each associated pair, the function of which will be described below. A threaded hole 300 is provided centrally through the plate portion 292, and a hole 302 extends through the plate portion 292 adjacent to an edge thereof for communication with the interior of the lower conical hollow portion 294.

Accordingly, a water tight sealing plug 76 provided on the opposite end of the water hose 56 is inserted into the hole 302 in order to supply water and the like to the interior of the conical hollow portion 294. As mentioned above, a plurality of openings 58 is provided in the bottom tip portion of the conical hollow portion 294, so that when the water supply is turned on at the time when the capping member 46 is positioned above or in the pipe 14 as indicated in FIG. 2, the water or the like will flow from the lower conical shaped hollow portion 294 onto or into the pipe 14 for cooling same and to help extinguish the fire 16.

A bolt 306 is inserted through the hole 288 in the plate 284 so that the head 308 of the bolt 306 is positioned in the recess 286 thereof. Accordingly, thre free end of the bolt 306 is threaded into the threaded opening 300 of the plate portion 292 of the capping member 36, by using an appropriate tool which is inserted into the cut out 290 of the carrier portion 252 for turning the head 308 of the bolt 306, in order to secure the capping member 46 to the carrier portion 252 of the carrier member 44. Obviously, the same type of tool can be used to unthread the bolt 306 when it is desired to detach the capping member 46 from the carrier member 44, as set forth below.

FIG. 14 shows a front view of the clamping device 12 when the jaws 34 of the apparatus 10 are in the closed position around the pipe 14 as indicated in FIG. 2. Accordingly, the clamping brackets 36 are engaged around the pipe 14 and the holes 142 in the brackets 140 of one clamping bracket 36 are in alignment with associated holes 142 in the brackets 140 of the other clamping bracket 36 on both the front and rear sides of the clamping brackets 36. Bolts 310 are inserted through the associated pairs of holes 142 and are secured therein by nuts 312 to secure the associated pair of brackets 140 together, where appropriate washers 314 can be used in this connection. The clamping brackets 36 are now securely mounted on the pipe 14.

As indicated above, the lower carrier portion 252 is free to pivot relative to the upper mounting portion 250 of the carrier member 44, shown best in FIG. 13, where the carrier portion 252 can also slide up and down between the side members 254 of the upper mounting portion 250. Thus, when the apparatus 10 is positioned adjacent to the pipe 14 as shown in FIG. 2, and as indicated in FIG. 14, it is required to adjust the carrier portion 252 so that the carrier portion 252 is in a stationary fixed position relative to the mounting portion 250, and it is also necessary to privide a downward force on the carrier portion 252 so that the carrier portion 252 forces the conically shaped hollow portion 294 of the capping member 46 into the opening in the pipe 14 to provide a force-fit arrangement therewith.

The above adjustment and downward force on the carrier portion 252 is provided by the above-mentioned threaded stud 268 which extends downwardly between the spaced apart side members 254 of the mounting member 250. Accordingly, the handle bars 274 on the pulley 272 secured to the threaded stud 268 are now turned to lower the threaded stud 268 downwardly into engagement with the upper end portion of the lower carrier portion 252 to fix the carrier portion 252 in a stationary position relative to the mounting portion 250. Furthermore, the threaded stud 268 also exerts a downward force on the carrier portion 252 so that the carrier portion 252 forces the conically shaped hollow portion 294 of the capping member 46, secured thereto, further downwardly into the opening in the pipe 14 to provide the force-fit arrangement therebetween.

It is noted, that in some cases, it is not possible to turn the handle bars 274 due to the extreme heat in the surrounding area. In these cases, a long wire (not shown) is looped around the pulley 272, and one end of the wire is held while the opposite end is pulled or the ends of the wire can be tied together and the wire is then pulled to rotate the pulley 272, which in turn will turn the threaded stud 268 so that the threaded stud 268 is threaded downwardly into engagement with the upper end portion of the lower carrier portion 252. Thus, the wire functions in the same manner as the handle bars 274.

Once the threaded stud 268 is in the above-mentioned engaged position on the upper end portion of the lower carrier portion 252, bolts 315 are inserted into associated slots 298 of the plate portion 292 and the slots 138 in the flanges 134, 136 of the clamping brackets 36, where associated ones of the slots 298, 138 are in alignment with each other to receive each associated bolt 315 therein. Buts 316 secure the bolts 315 and tighten same to secure the capping member 36 to the clamping brackets 36 of the clamping device 12, as shown in FIG. 15. Accordingly, washers 317 can be used in this connection if desired. The clamping device 12 is now securely mounted on the pipe 14, where the capping member 46 and the clamping brackets 36 form a unit construction.

When the brackets 36 are secured on the pipe 14, as mentioned above, the bolts 148 are removed to detach the L-shaped members 100, 108 of the jaws 34 from the brackets 144 of the clamping brackets 36. Additionally, when the capping member 46 is secured to the brackets 36, as mentioned above, the bolt 306 is unthreaded to detach the capping member 46 from the carrier member 44, in the manner indicated above. Furthermore, the sealing plug 76 of the water hose 56 is also unplugged from the hole 302 in the plate portion 292 of the capping member 46. If necessary, the hole 302 in the plate portion 292 is now plugged with suitable means. The apparatus 10 is now moved away from the pipe 14, thus leaving the clamping device 12 on the pipe 14 for capping same to put out the fire 16 therein, as shown in FIG. 15.

Figure 16:
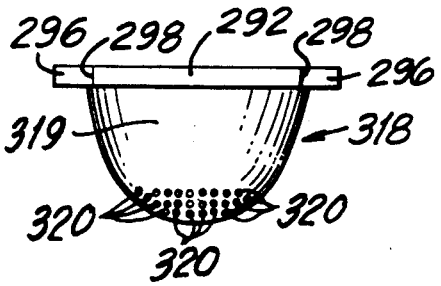
FIG. 16 is an elevational view showing a modified capping member.

Though the lower portion of the capping member 46 was shown as a conically shaped hollow portion 294, other configurations can also be used, where obviously each is fabricated from fire resistant material. FIG. 16 shows a modified capping member 318 including the upper plate portion 292, as mentioned above, and a lower hemispherically shaped hollow portion 319 having a plurality of openings 320 provided in the bottom portion thereof for the reasons mentioned above.

Figure 17:
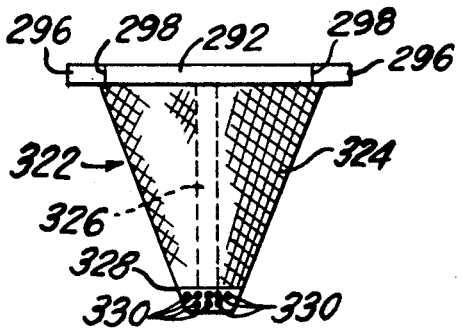
FIG. 17 is an elevational view showing a further modified capping member.

Likewise, FIG. 17 shows a further modified clamping member 322 including the upper plate portion 292, as mentioned above, and a lower downwardly tapered portion 324 fabricated from fire resistant material compressed together. Accordingly a horizontally extending hollow core 326 is provided through the lower portion 324 ending with a nozzle 328 exposed at the bottom of the lower portion 324. The nozzle 328 has a plurality of openings 330 therein for spraying water and the like on the fire 16, as indicated above, where the upper end of the hollow core 326 is disposed in the opening 302 of the plate portion 292 for receiving the nozzle 76 of the water hose 56, as explained above.

Figure 18:
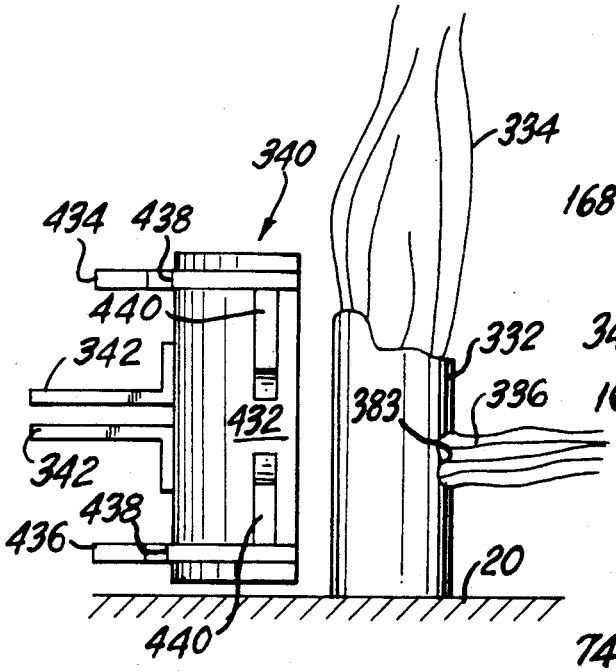
FIG. 18 is an elevational view showing a modified clamping bracket.

Obviously, not all pipes are the same size, either in height or in diameter, and are not damaged in the same manner, where FIG. 18 shows a pipe 332 which is shorter than the above-mentioned pipe 14, and also has a first flame 334 streaming out from the top thereof and a second flame 336 shooting out of a hole 338 in the side of the pipe 332. Furthermore, the pipe 332 has a smaller diameter than the above-mentioned pipe 14. Accordingly, a pair of modified clamping brackets 340 is used for the pipe 332, as shown in FIG. 18.

The clamping bracket 340 is basically the same as the above-mentioned clamping bracket 36, having upper and lower flanges 434, 436 with the slots 438 therein, which are connected to the body member 432 which is provided with the vertically extending brackets 440. However, the clamping brackets 340 when secured together have a smaller diameter than the above-mentioned clamping brackets 36. Additionally, the above-mentioned L-shaped brackets 144 secured to the above-mentioned body members 132 have been modified as L-shaped brackets 342, where the main change thereof was to increase the length of the horizontal legs of the former L-shaped brackets 144 so that the modified clamping brackets 340 with their modified L-shaped brackets 342 secured to the body members 432 can be used for attachment to the above-mentioned jaws 34 in the same manner as mentioned above, in order to fit around the pipe 332. It is noted, that the body member 432 of the clamping bracket 340 will be used as an extension for the pipe 332 into which any one of the capping members 46, 316, 322 will be inserted. Furthermore, the body member 432 of the clamping bracket 340 when secured on the pipe 332 will close off the hole 338 in the pipe 332.

In many instances it may be desired to raise the height of the jaws 34 and/or the height of the arms 42 and the carrier member 44 supported therefrom. Accordingly, all that need be done is to change the outer frame members 60 of the apparatus 10, best shown in FIG. 3, for modified outer frame members 344 shown in FIG. 19. Accordingly, the modified outer frame members 344 can be made for any vertical height desired, where the openings therethrough are suitably made to receive the bolts 68 and 162 therethrough for securing the inner frame members 62 of the lower portion 32 and the H-shaped inner frame members 152 of the upper portion 38 thereto in the same manner as set forth above. Accordingly, the inner frame members 62 can be spaced above the skids 18, which rest on the ground 20, by any desired distance. Likewise, the H-shaped inner frame members 152 would be mounted adjacent to the top portions of the outer frame members 344, where by making the outer frame members 344 a predetermined length, the H-shaped inner frame members 152 could be spaced above the inner frame members 62 any desired predetermined distance.

Numerous alterations of the structures herein discussed will suggest themselves to those skilled in the art. However, it is to be understood that the present disclosure relates to preferred embodiments of the invention which are for the purpose of illustration only, and are not to be construed as a limitation of the invention.

What is claimed is:

1. A clamping device for capping a pipe carrying fluids therein, comprising:

clamping brackets for securement on the pipe;

a capping member for insertion into an open end of the pipe, said capping member including an upper plate portion and a lower capping portion fixedly secured to said plate portion as an integral unit;

fastener means for securing said upper plate portion to said clamping brackets to provide a unit construction when securely mounted on the pipe;

each of said clamping brackets including a semi-circular body member having spaced apart upper and lower semi-circular flanges secured to an outer wall of said body member; and a pair of spaced apart slots being provided in each of said upper and lower flanges, said slots in said upper flange being in alignment with an associated one of said slots in said lower flange for receiving said fastener means therein.

2. A clamping device according to claim 1, wherein said clamping brackets include first attachment means to removably secure said clamping brackets to an apparatus for mounting said clamping device on the pipe, and said capping member including second attachment means to removably secure said capping member to the apparatus.

3. A clamping device according to claim 1, wherein said lower capping portion is a conically shaped hollow portion.

4. A clamping device according to claim 1, wherein said lower capping portion is a hemispherically shaped hollow portion.

5. A clamping device according to claim 1, wherein said lower capping portion is a downwardly tapered portion fabricated from fire resistant material.

6. A clamping device for capping a pipe carrying fluids therein, comprising:

clamping brackets for securement on the pipe;

a capping member for insertion into an open end of the pipe, said capping member including an upper plate portion and a lower capping portion fixedly secured to said plate portion as an integral unit;

fastener means for securing said upper plate portion to said clamping brackets to provide a unit construction when securely mounted on the pipe; and said lower capping portion including means for spraying said clamping brackets and the pipe with water, chemicals and like material for cooling same.

7. A clamping device according to claim 6, wherein each of said clamping brackets includes a semi-circular body member having spaced apart upper and lower semi-circular flanges secured to an outer wall of said body member.

8. A clamping device according to claim 6, wherein said clamping brackets include first attachment means to removably secure said clamping brackets to an apparatus for mounting said clamping device on the pipe, and said capping member including second attachment means to removably secure said capping member to the apparatus.

9. A clamping device according to claim 6, wherein said lower capping portion is a conically shaped hollow portion.

10. An apparatus for mounting a clamping device including clamping brackets for securement on a fluid carrying pipe and a capping member for insertion into an open end of the pipe for capping the pipe, comprising:

a lower portion including closable jaw means for securement to the clamping brackets to engage the clamping brackets around the pipe;

an upper portion including arm means provided with a carrier member for holding the capping member to position the capping member within the open end of the pipe;

frame means for securing said upper portion to said lower portion; and rod means for opening and closing said jaw means.

11. An apparatus according to claim 10, wherein said rod means also rotates said jaw means to position said clamping brackets relative to the pipe.

12. An apparatus for mounting a clamping device including clamping brackets for securement on a fluid carrying pipe and a capping member for insertion into an open end of the pipe for capping the pipe, comprising:

a lower portion including closable jaw means for securement to the clamping brackets to engage the clamping brackets around the pipe;

an upper portion including arm means provided with a carrier member for holding the capping member to position the capping member within the open end of the pipe;

frame means for securing said upper portion to said lower portion; and said arm means including a pair of spaced apart arms pivotally secured on opposite sides of a yoke member, said yoke member being secured to said frame means.

13. An apparatus according to claim 12, including rod means connected to a first end of each of said arms for raising and lowering an opposite free second end of each of said arms.

14. An apparatus according to claim 13, wherein said rod means include a rod having a threaded portion, and a drive member threadably engaged on said threaded portion, opposite ends of said drive member being movably engaged in a slot provided in said first end of each of said arms so that rotation of said rod moves said drive member and said first end of each of said arms along said threaded portion of said rod.

15. An apparatus according to claim 12, including rod means engageable with opposite ends of said yoke member for rotating said yoke member and said arms secured to said yoke member.

16. An apparatus according to claim 15, wherein said rod means includes a rod having non-circular members thereon for matingly engaging in non-circular holes in said opposite ends of said yoke member for rotating said yoke member.

17. An apparatus for mounting a clamping device including clamping brackets for securement on a fluid carrying pipe and a capping member for insertion into an open end of the pipe for capping the pipe, comprising:

a lower portion including closable jaw means for securement to the clamping brackets to engage the clamping brackets around the pipe;

an upper portion including arm means provided with a carrier member for holding the capping member to position the capping member within the open end of the pipe;

frame means for securing said upper portion to said lower portion;

said carrier member including an upper mounting portion secured to free ends of said arms; and said carrier member including a lower carrier portion for releasably holding the capping member, said carrier portion being pivotally secured to said mounting portion.

18. An apparatus according to claim 17, including means for maintaining said carrier portion in a stationary fixed position relative to said mounting portion, and also for providing a downward force on said carrier portion so that the capping member is forced into the open end of the pipe.

19. An apparatus for mounting a clamping device including clamping brackets for securement on a fluid carrying pipe and a capping member for insertion into an open end of the pipe for capping the pipe, comprising:

a lower portion including closable jaw means for securement to the clamping brackets to engage the clamping brackets around the pipe;

an upper portion including arm means provided with a carrier member for holding the capping member to position the capping member within the open end of the pipe;

frame means for securing said upper portion to said lower portion; and said jaw means being movably connected to a hollow tubular member horizontally disposed in said lower portion of said apparatus.

20. An apparatus according to claim 19, wherein said hollow tubular member is provided with a water tight arrangement, said hollow tubular member including means for spraying the clamping brackets and the pipe with water, chemicals and like material for cooling same.

* * * * *